United States Patent [19]

Dahl

[11] 4,060,173

[45] Nov. 29, 1977

[54] CONTAINER

[75] Inventor: Nils J. Dahl, Barrington, R.I.

[73] Assignee: Crystal Thermoplastics, Inc., Ashton, R.I.

[21] Appl. No.: 741,861

[22] Filed: Nov. 15, 1976

[51] Int. Cl.[2] ..... B65D 1/34; B65D 1/44; B65D 5/36

[52] U.S. Cl. ..... 220/4 B; 220/306; 220/339; 150/.5

[58] Field of Search ..... 220/352, 339, 4 B; 150/.5

[56] References Cited

U.S. PATENT DOCUMENTS

| | | | |
|---|---|---|---|
| 3,484,015 | 12/1969 | Rowan | 220/4 E |
| 3,556,337 | 1/1971 | Harmon et al. | 220/339 |
| 3,565,146 | 2/1971 | Arnolds | 220/4 B X |
| 3,664,538 | 5/1972 | Fioretti | 220/4 E |
| 3,693,410 | 9/1972 | Robrecht et al. | 220/4 B UX |
| 3,797,649 | 3/1974 | Ringle | 220/339 X |
| 3,902,598 | 9/1975 | Koob et al. | 220/4 E X |

*Primary Examiner*—Davis T. Moorhead
*Attorney, Agent, or Firm*—Barlow & Barlow

[57] ABSTRACT

A container formed from a flexible sheet of resilient thermoplastic resin having a body section and a cover section which are hinged together, each having side and end walls which telescope together, the holding of the hinged sections together being by means of undercuts in the corners of the meeting side and end walls of the sections.

2 Claims, 7 Drawing Figures

CONTAINER

BACKGROUND OF THE INVENTION

In containers which are formed from resilient sheet plastic material, it has been usual to form means to lock the sections which are hinged together by means of protuberances on the telescoping side walls of one section and recesses on the side wall of the other section along the walls which are distant from the hinge in order to hold the two sections in closed position. This does not lock the sections along the hinge side of the box together and because of the resiliency of the box does not form a firm connection between the sections when closed.

SUMMARY OF THE INVENTION

A rectangular container of resilient sheet material such as thermoplastic resin formed in a vacuum drawn mold providing two sections of sheet material hingedly joined and all integral. Each section has angularly meeting walls which telescope together. When the walls of the sections are telescoped one into the other, the locking of sections is formed by undercutting the inside of the corners of the outer telescoping walls and undercutting the outer side of the corners of the inner telescoping walls. Locking of all corners of the formed box assures a very tight lock of two sections when in closed position.

DESCRIPTION OF THE PREFERRED EMBODIMENT

Figure 1:
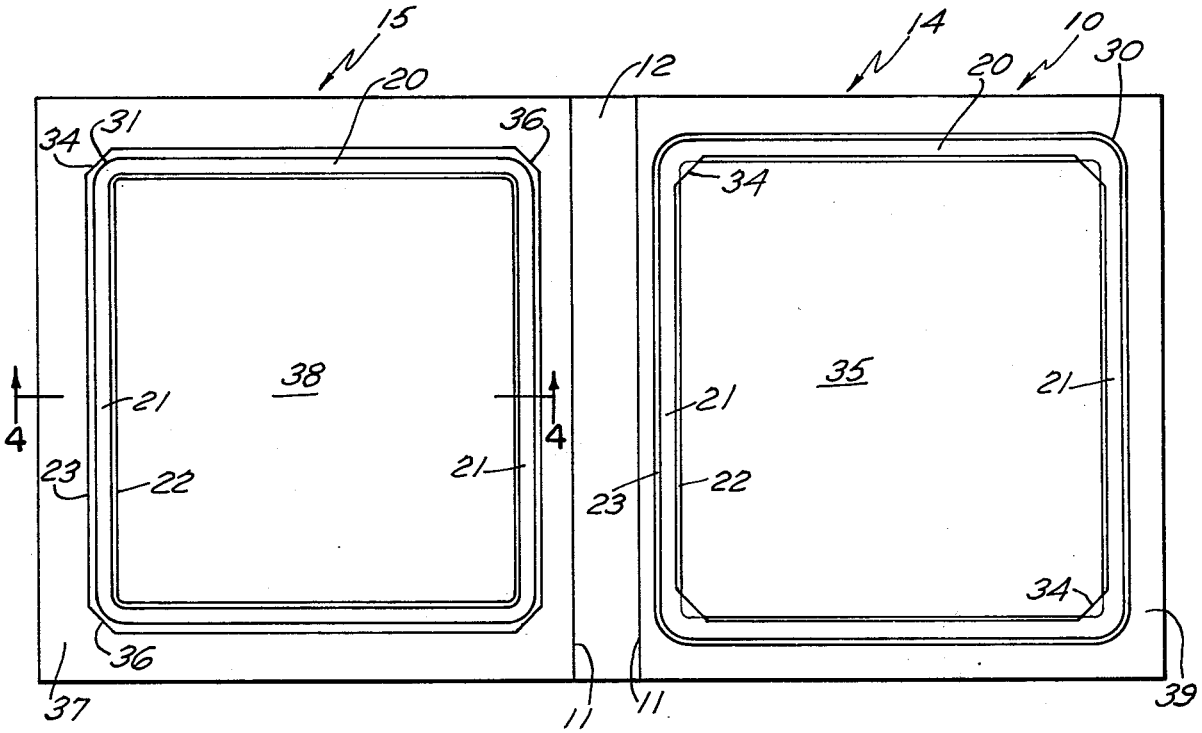
FIG. 1 is a top plan view of the container in open position showing the same as it comes from the thermoplastic vacuum forming mold.
Figure 2:
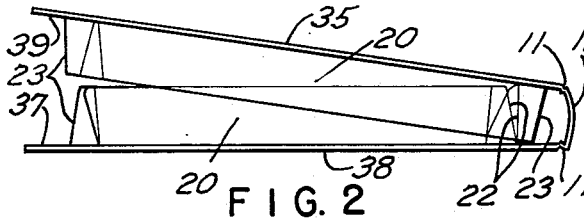
FIG. 2 is an end elevation showing the two sections approximating closed position.
Figure 4:
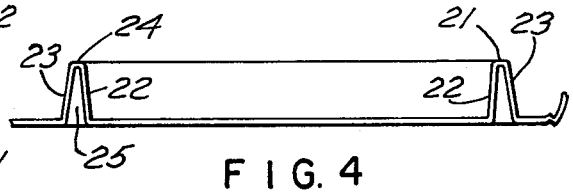
FIG. 4 is a section on line 4—4 of FIG. 1.
Figure 3:
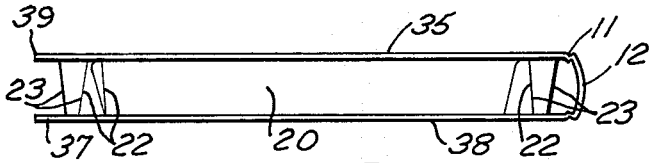
FIG. 3 is an end elevation showing the sections in closed position.
Figure 6:
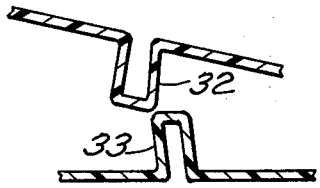
FIG. 6 is a sectional view on substantially line 7—7 of FIG. 5 through the corner with the two sections separated.
Figure 5:
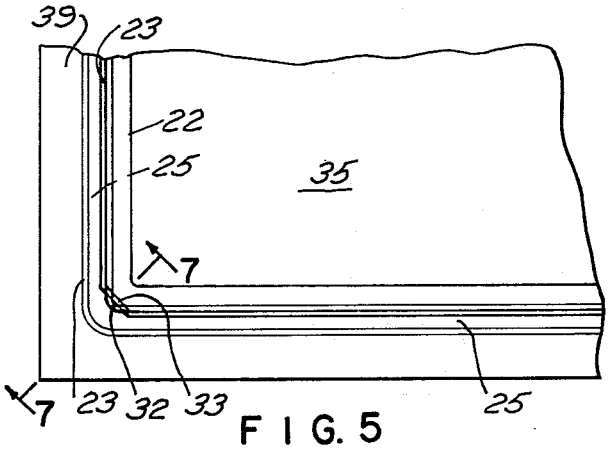
FIG. 5 is a top plan view of the container in closed position.
Figure 7:
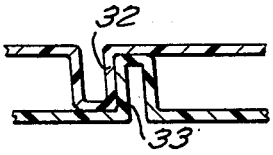
FIG. 7 is a sectional view on line 7—7 of FIG. 5 with the sections in closed position.

In FIG. 1 there is a sheet of thermoplastic material designated 10 as it comes from the vacuum forming mold in which there is either a stepped channel or a pair of spaced scored lines at 11 forming between them a hinge 12 connecting the two sections designated generally 14 and 15. In this vacuum forming mold the sheet stock is raised to form side walls 20 and end walls 21. These walls are each of doubled sheet stock in spaced relation as shown in FIG. 4 where there is an inner wall portion 22 and an outer wall portion 23 with a somewhat flattened end at 24 having a space 25 between the wall portions. These walls extend in substantially this formation completely around the four side and end walls of the box so that the side walls 20 and the end walls 21 are the same formation. The side and end walls join to form corners designated generally 30 for each of the corners in the section 14 and 31 for the corners in the section 15. The side and end walls of section 15 telescope into the side and end walls of section 14. The corners 30 of the section 14 are undercut on their inner surfaces as at 32 (see FIGS. 6 and 7) by reason of the undercut being on the meeting inner walls 22, whereas the corners 31 of section 15 are undercut on their outer surfaces as at 33 (FIGS. 6 and 7) by reason of the undercut being on the meeting outer walls 23 so that when the sections are brought together one will by an interference fit pass the other and the corners will lock as shown in FIG. 7.

It will be noted that the corners 30 have the inner wall 22 joined by a straight portion 34 at their top edge 24 which overhangs the closure wall 35 of section 14 and that corners 31 of section 15 have the outer wall 23 joined by a straight portion 36 at is juncture with the flat sheet stock flange 37 in the plane of closure wall 38 enhancing the undercut of these corners 31 and receiving the straight portion 34 of the corners of the section 14.

By reason of all four corners of the box being undercut a very firm connection is provided as the interlocking of the corners pull the walls together and yet because of the resiliency of the sheet material permits the box to be pulled open by means of its opposite flanges such as 37 and 39. When there is a release of the walls distant from the hinge, the walls adjacent the hinge easily open one from the other.

I claim:

1. A container formed from a flexible sheet of resilient thermoplastic resin and having a body section and a cover section hinged together by a hinge integral with both sections, each section having a closure wall with side and end walls of a size to telescope one into the other when the sections are in closed relation, said side and end walls meeting in angular relation to form corners, all of said corners of the inner telescoping walls being undercut in a plane at an angle to both meeting walls on their outer surfaces and all of said corners of the outer telescoping walls being undercut in a plane at an angle to both meeting walls on the inner surfaces whereby the undercut corners of the sections will lock at all of the corners when the body and cover sections are in closed position.

2. A container as in claim 1 wherein the walls are double and of a sheet material integral with the remainder of the section.

* * * * *